United States Patent [19]

Goettl

[11] 4,132,087

[45] Jan. 2, 1979

[54] AIR CONDITIONING ASSEMBLY

[76] Inventor: Adam D. Goettl, 4960 E. Palomina Rd., Phoenix, Ariz. 85018

[21] Appl. No.: 838,495

[22] Filed: Oct. 3, 1977

Related U.S. Application Data

[63] Continuation-in-part of Ser. No. 655,868, Feb. 6, 1976, abandoned.

[51] Int. Cl.[2] ..... F25D 21/14

[52] U.S. Cl. ..... 62/285; 62/DIG. 16; 62/412; 165/59; 165/60

[58] Field of Search ..... 165/59, 60; 62/DIG. 16, 62/263, 409–412, 285; 98/43 R, 33 R

[56] References Cited

U.S. PATENT DOCUMENTS

| | | | |
|---|---|---|---|
| 2,620,722 | 12/1952 | Owens | 98/94 |
| 3,212,288 | 10/1965 | Herbert | 165/70 X |
| 3,330,379 | 7/1967 | Cook | 98/43 R X |
| 3,802,493 | 4/1974 | Goettl | 165/60 |
| 4,043,777 | 8/1977 | Parren | 62/DIG. 16 X |

*Primary Examiner*—Charles J. Myhre
*Assistant Examiner*—Margaret LaTulip
*Attorney, Agent, or Firm*—Herbert E. Haynes, Jr.

[57] ABSTRACT

An air conditioning structure having a depending centrally located outlet opening and auxiliary air inlets disposed laterally with respect thereto in combination with an air handling mechanism coupled to the outlet and auxiliary air inlets thereof. The air handling mechanism is located within a special support frame for the air conditioning structure, with the frame being adapted to retain and protect insulative material adjacent the exterior surfaces of the air handler mechanism. The air handling mechanism includes a central supply duct for conducting air from the air conditioning structure to a point of use and has a pair of laterally disposed return air handler ducts for conducting and treating the air returned from the point of use to the air conditioning structure, and further includes an exhaust duct extending from the supply duct by which air from the point of use may optionally be exhausted to ambient.

12 Claims, 6 Drawing Figures

AIR CONDITIONING ASSEMBLY

CROSS REFERENCE TO RELATED APPLICATION

This application is a continuation-in-part of a copending prior application entitled AIR CONDITIONING ASSEMBLY, Ser. No. 655,868, filed Feb. 6, 1976 by the same inventor, now abandoned.

BACKGROUND OF THE INVENTION

1. Field of the Invention

This invention relates to air conditioning devices and more particularly to an air conditioning structure in combination with an air handling mechanism.

2. Description of the Prior Art

The air conditioning structure which forms part of the combination of the present invention is fully disclosed in U.S. Pat. No. 3,802,493, issued on Apr. 9, 1974 to the same inventor. That particular air conditioning structure is in the form of an especially designed multifunction evaporative cooler having, among other things, a sump portion which is divided into a liquid reservoir section and a duct section. The duct section is in turn divided into a central outlet opening and a pair of laterally oppositely positioned auxiliary inlet openings.

The outlet opening delivers air supplied by the centrifugal blower of the air conditioning structure to a point of use such as the interior of a building, and the auxiliary inlet openings usually direct air returning from the point of use to the inlets of the centrifugal blower. Such recirculation of air is an optional feature of the air conditioning structure and therefore, a damper assembly is located within each of the auxiliary inlet openings for selective opening and closing thereof. The auxiliary inlet openings may also be provided with air treatment mechanisms such as heat exchanger devices for heating or cooling of the returning air.

Due to the physical size limitations of the auxiliary inlet openings, and due to the placement of the damper assemblies and the air treatment mechanisms therein, the air treatment mechanisms are limited as to the size that can be employed therein. Further, location of the damper assemblies and air treatment devices within the auxiliary air inlets of the air conditioning structure causes problems with durability and serviceability of those devices.

It is well known that an evaporative cooler by design is subject to severe corrosion problems and the mechanisms and other hardware thereof are especially designed and fabricated to withstand the highly corrosive atmosphere. However, air treatment mechanisms such as heat exchanger coils, are not devices which are usually employed in conjunction with an evaporative cooler and cannot tolerate such a hostile environment.

With regard to serviceability, replacement and/or servicing of the damper assemblies and the air treatment devices is extremely difficult when those mechanisms are located within the auxiliary air inlet openings of the air conditioning structure due to the location of those openings and the manner in which the damper assemblies and air treatment devices are densely mounted therein.

Therefore, a need exists for a new and improved air handling mechanisms in combination with an air conditioning structure which overcomes some of the problems of the prior art.

SUMMARY OF THE INVENTION

In accordance with the present invention, a new and improved air conditioning assembly is disclosed as including an air handling mechanism in combination with a specific air conditioning structure.

The specific air conditioning structure, as previously described, is an especially configured multipurpose evaporative cooling structure having a sump which is provided with a centrally located outlet opening and a pair of oppositely laterally positioned auxiliary air inlet openings.

The air handler mechanism, which forms part of the combination of the present invention, includes a central supply spanner duct having an identical pair of return air handler ducts mounted on opposite sides thereof and an exhaust duct extending from the supply spanner duct. The air handler mechanism is configured to be coupled to the air conditioning structure so that the supply spanner duct and the return air handler ducts of the air handler mechanisms are respectively in communication with the outlet opening and auxiliary air inlet openings of the air conditioning structure. The air handler mechanism is located within the special support frame for the air conditioning structure with the frame being adapted to retain insulative material against the peripheral surfaces of the air handler mechanism and to protect that material from the elements.

Each of the return air handler ducts of the air handler mechanism is provided with an enlarged chamber in which air treatment devices, such as heat exchanger coils, are mounted, and for containing air flow control damper assemblies.

Each of the return air handlers is also provided with a liquid drainage system for removal of liquid such as would normally result from condensation on heat exchanger mechanisms.

The exhaust duct which extends from the supply spanner duct of the air handler mechanisms provides the air conditioning assembly of the present invention with the capability of exhausting air from the point of use into the atmosphere. The junction of the supply spanner duct with the exhaust duct is provided with a damper device by which air exiting from the outlet opening of the air conditioning structure may optionally be returned to the point of use through the supply spanner duct or may be exhausted to the atmosphere through the exhaust duct.

It will now be seen that the above described air handler mechanisms in combination with the specific air conditioning structure provides an extremely flexible, multifunction and economic air conditioning combination in which a variety of air treatment devices of various sizes may be employed, and in which durability and access for servicing is enhanced.

Accordingly, it is an object of the present invention to provice a new and improved air conditioning assembly.

Another object of the present invention is to provide a new and improved air conditioning assembly which combines an air conditioning structure with an air handler mechanism.

Another object of the present invention is to provide a new and improved air conditioning assembly which combines an air conditioning structure with an air handler mechanism with the air handler mechanism adapted to conduct air supplied by and returned to the air conditioning structure and to treat the returning air.

Another object of the present invention is to provide a new and improved air conditioning assembly which combines an air conditioning structure with an air handler mechanism, with that air handler mechanism including an air supply duct and at least one return air handler duct having an air treatment device mounted therein.

Another object of the present invention is to provide a new and improved air conditioning assembly which combines an air conditioning structure with an air handler mechanism, with that air handler mechanism including at least one return air handler duct having an air treatment device in the form of a heat exchanger mounted therein.

Another object of the present invention is to provide a new and improved air conditioning assembly which combines an air conditioning structure with an air handler mechanism, with the air handler mechanism including an air supply duct and at least one return air handler duct having an air treatment device therein, and further including an exhaust duct extending from the air supply duct by which air from the air conditioning structure may be optionally exhausted into the atmosphere.

Still another object of the present invention is to provide a new and improved air conditioning assembly of the above described character in which the return air handler duct is provided with an enlarged chamber therein for containing the air treatment device and in which a liquid drainage system and an air flow control damper assembly are mounted.

Yet another object of the present invention is to provide a new and useful air conditioning assembly of the above described character in which the air handler mechanism is enclosed within a special stand which, in addition to supporting the air conditioning assembly, retains insulative material in engagement with the peripheral surfaces of the air handler mechanism and protects that insulation from the elements.

The foregoing and other objects of the present invention, the various features thereof as well as the invention itself, may be more fully understood from the following description when read in conjunction with the accompanying drawings.

DESCRIPTION OF THE PREFERRED EMBODIMENT

Figure 1:
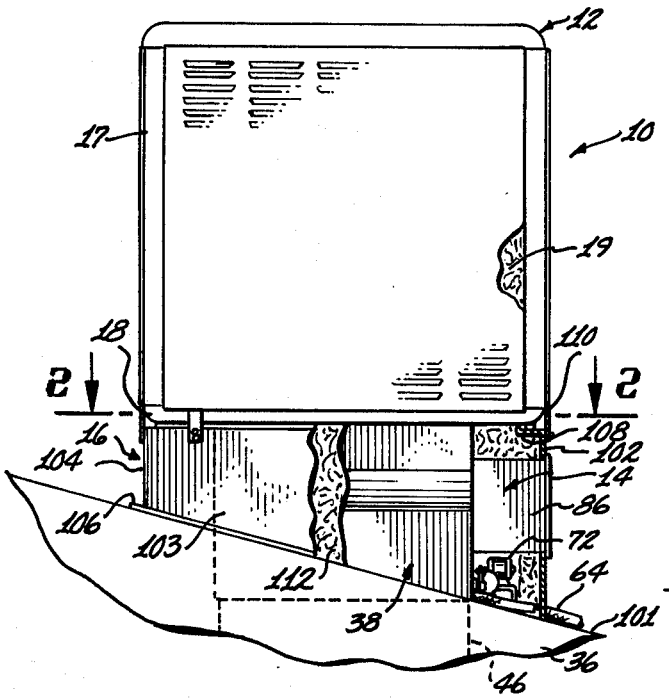
FIG. 1 is a side elevational view of the air conditioning assembly of the present invention with portions broken away to illustrate the various features thereof.

Referring more particularly to the drawings, FIG. 1 illustrates the air conditioning assembly of the present invention which is indicated in its entirety by the reference numeral 10, and is shown to include the combination of an air conditioning structure indicated generally by the numeral 12, an air handling mechanism indicated generally by the numeral 14, and an enclosure-stand indicated generally by the numeral 16.

The air conditioning structure 12 is fully described in the hereinbefore referenced U.S. Pat. No. 3,802,493, and therefore will be only briefly described herein.

Figure 4:
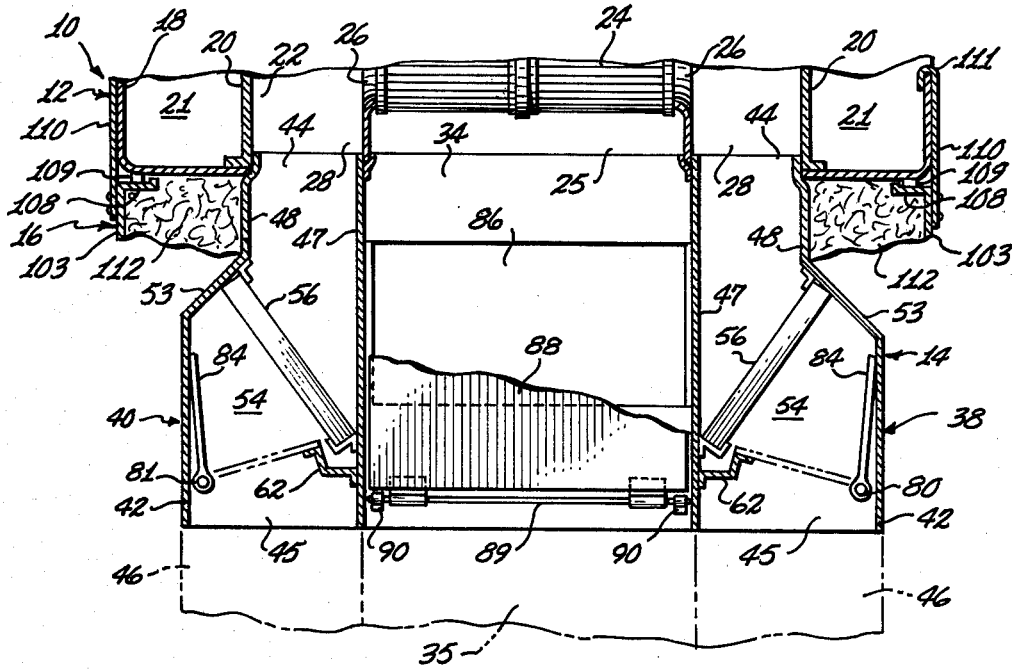
FIG. 4 is an enlarged sectional view taken along the line 4—4 of FIG. 2.

As shown best in FIGS. 1 and 4, the air conditioning structure 12 is in the form of a downdraft evaporative cooler which comprises a housing 17 having a sump 18, and is equipped with a plurality of conventional evaporative cooler pads 19 (one shown) mounted in the sides of the housing in a well known manner. The sump 18 of the air conditioning structure 12 is provided with an upstanding endless sump barrier 20 which divides the sump into a reservoir compartment 21 and a duct passage 22. A centrifugal blower assembly 24 is mounted within the housing 17 so that its centrifugal outlet 25 is directed downwardly through the duct passage 22 of the sump 18. The centrifugal blower assembly 24 has the usual pair of oppositely positioned air inlets 26 so that during normal operation of the air conditioning structure 12, outside ambient air is drawn through the cooler pads 19 into the air inlets 26 of the centrifugal blower 24 and is discharged through the centrifugal outlet 25.

In addition to the centrifugal blower outlet 25 being located within the duct passage 22, a pair of auxiliary air inlets 28 are formed therein so as to be laterally oppositely positioned with respect to the centrifugal blower outlet. As disclosed in the hereinbefore referenced U.S. patent, the air conditioning structure 12 also includes a pair of upper damper assemblies (not shown) and a pair of lower damper assemblies (not shown). The upper damper assemblies are positioned in the air flow path between the cooler pads 19 and the air inlets 26 of the centrifugal blower assembly 24, and the lower damper assemblies are located within the auxiliary air inlets 28 formed in the sump 18. Thus, the air which is drawn into the air inlets 26 of the centrifugal blower assembly 24 by normal operation thereof, may be selectively directed thereto through either the cooler pads 19 or through the auxiliary air inlets 28 by appropriate positioning of the damper assemblies (not shown).

It may now be appreciated that the air conditioning structure 12 as described above, is capable of employing outside ambient air in the performance of its evaporative cooling function as is customary in the art, and also includes the capability of moving air supplied thereto through the auxiliary air inlets 28. This additional capability is employed for the recirculation of air initially supplied to a point of use by the centrifugal blower assembly 24, and the recirculating air may be treated such as by heating, cooling, and/or filtering, as will hereinafter be described in detail.

Figure 2:
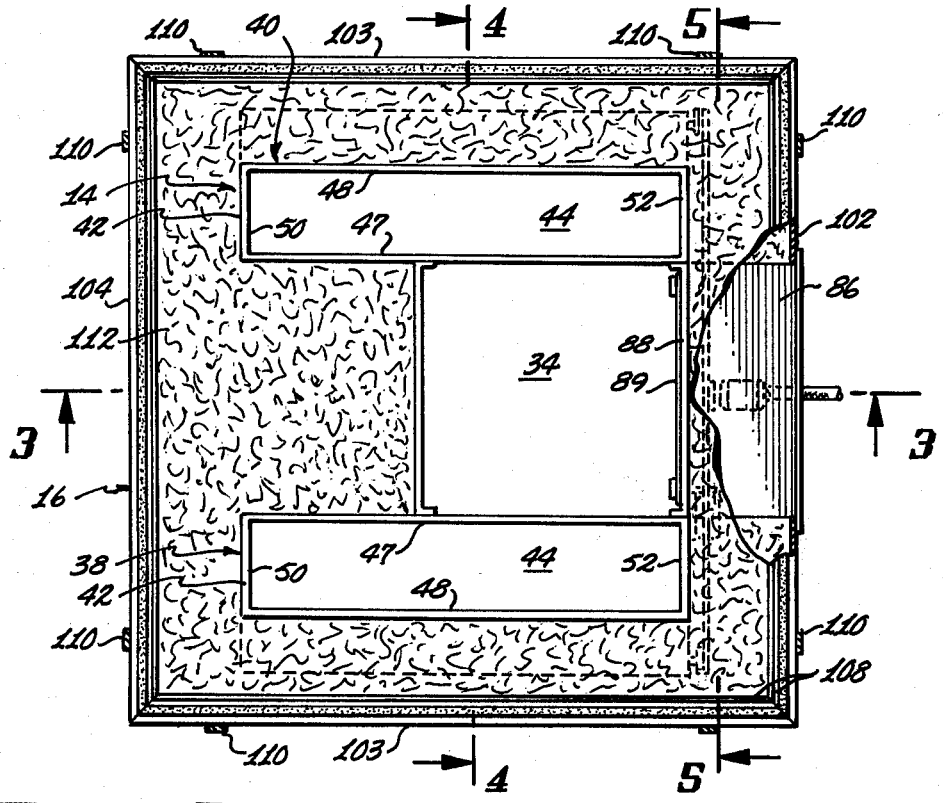
FIG. 2 is a sectional view taken along the line 2—2 of FIG. 1.

As shown best in FIGS. 2 and 4, the air handling mechanism 14 includes a centrally located supply spanner duct 34 which is coupled to the centrifugal outlet 25 of the air conditioning structure 12, and is adapted to be coupled to a suitable supply duct 35 of the type normally provided within a building 36. The supply spanner duct 34 functions to deliver air from the centrifugal blower assembly 24 to the supply duct 35 which distributes the supplied air within the building 36.

The air handling mechanism 14 also includes a pair of return air handler ducts 38 and 40 with each of those return air handler ducts suitably affixed to a different one of the opposite sides of the spanner duct 34.

The return air handler ducts 38 and 40 are identical and therefore the following detailed description of the handler duct 38 will be understood to also apply to the handler duct 40.

The return air handler duct 38 is preferably a sheet metal structure formed in accordance with techniques well known in that art, and is seen to include a housing 42 having an outlet opening 44 formed in one end thereof and an inlet opening 45 formed in the opposite end. The outlet opening 44 of the housing 42 is sized and configured for coupling to one of the auxiliary inlet openings 28 formed in the sump 18 of the air conditioning structure 12. The inlet opening 45 of the housing 42 is adapted for coupling to one of a pair of return air ducts 46 provided in the building 36. Thus, the return air handler duct 38 is seen to deliver air returning from the building 36 to the air conditioning structure 12 to provide the hereinbefore mentioned recirculating capability.

The housing 42 of the return air handler duct 38 is formed to have an inwardly disposed side wall 47, an outwardly disposed side wall 48, and an oppositely spaced pair of end walls 50 and 52. The inwardly disposed side wall 47 of the housing 42 is substantially of planar configuration and a portion thereof forms a common side wall of the supply spanner duct 34. The outwardly disposed side wall 48 is preferably formed with an outwardly angularly extending intermediate segment 53 to provide an enlarged chamber 54 within the housing 42, with that chamber 54 having a substantially larger cross sectional area than the outlet opening 44 of the housing 42.

The enlarged chamber 54 provided in the housing 42 has at least one air treatment device 56 mounted therein such as on suitable brackets, with those brackets preferably positioned so that the air treatment device 56 is angularly oriented within the enlarged chamber 54. In this manner, the air treatment device 56 mounted within the chamber 54 can be sized to have a relatively larger surface area than would otherwise be possible.

The air treatment device 56 may take the form of a heat exchanger, such as the evaporator coil of a remotely located refrigeration unit (not shown), the radiator of a remotely located heat producing device (not shown), a coil through which a chilled or heated liquid is circulated, and the like. The air treatment device 56 may also take the form of an air filter (not shown).

Figure 5:
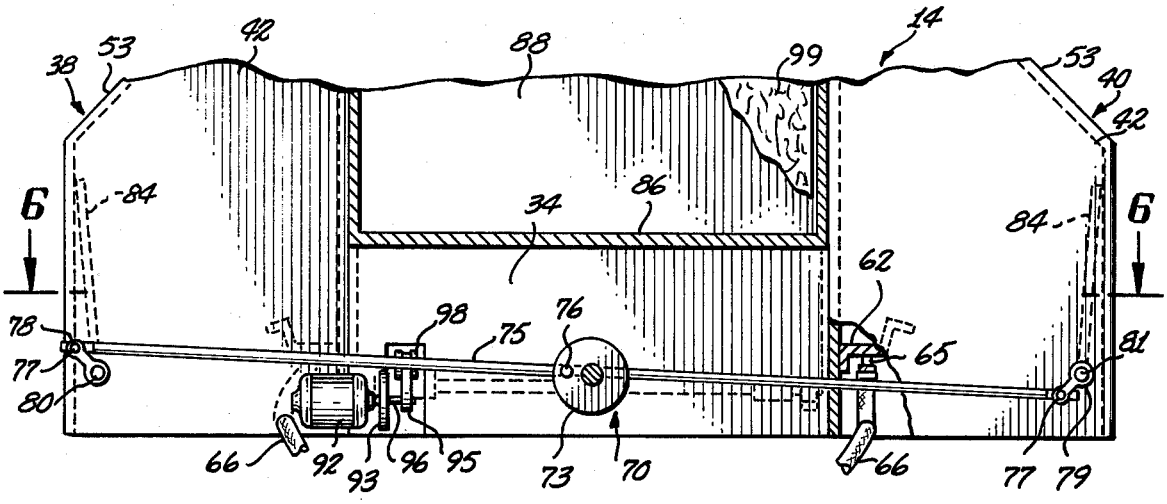
FIG. 5 is an enlarged fragmentary sectional view taken on the line 5—5 of FIG. 2.
Figure 6:
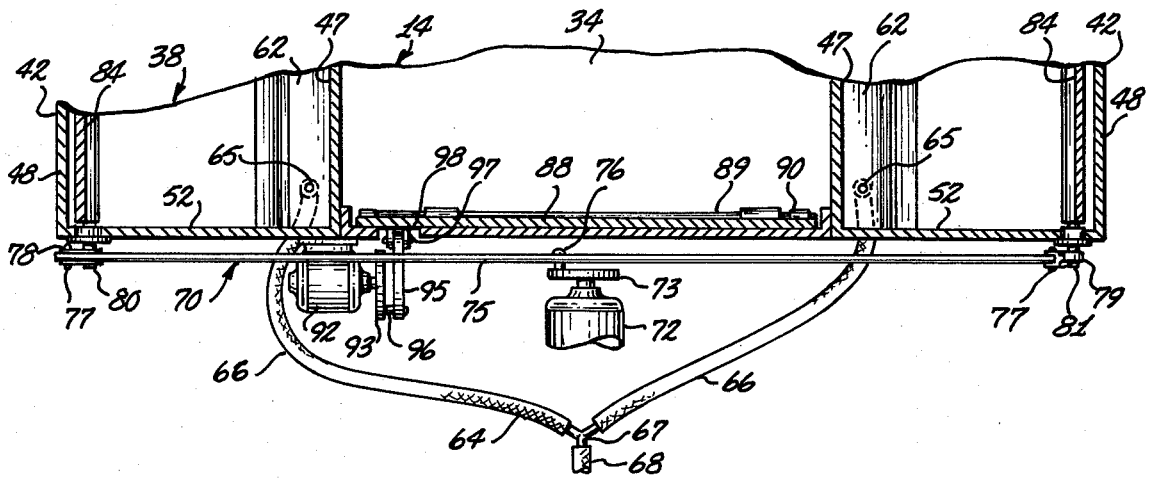
FIG. 6 is a fragmentary sectional view taken on the line 6—6 of FIG. 5.

The return air handler duct 38 is provided with a liquid removal system which, as best seen in FIGS. 5 and 6, includes a liquid collecting trough 62 and a liquid disposal manifold 64. The trough 62 is suitably affixed to the interior surface of the inwardly disposed side wall 47 of the housing 42 and extends between the end walls 50 and 52 thereof. The trough 62 is located immediately below the lowermost end of the angularly disposed air treatment device 56 so as to collect any liquid that may fall therefrom such as would occur as a result of condensation forming on a heat exchanger during a cooling cycle.

The trough 62 of each of the return air handler ducts 38 and 40 each have an outlet pipe 65 depending therefrom to which the liquid disposal manifold 64 is coupled. The manifold includes a pair of hoses 66, each coupled to a different one of the outlet pipes 65 and also connected to a collector fitting 67 which also has a drain hose 68 connected thereto. Thus, liquid collected in the troughs 62 will flow through the hoses 66 to the collector fitting 67 and subsequently into the drain hose 68 which conducts that liquid to a suitable point of disposel (not shown) remote from the air conditioning assembly 10.

Figure 3:
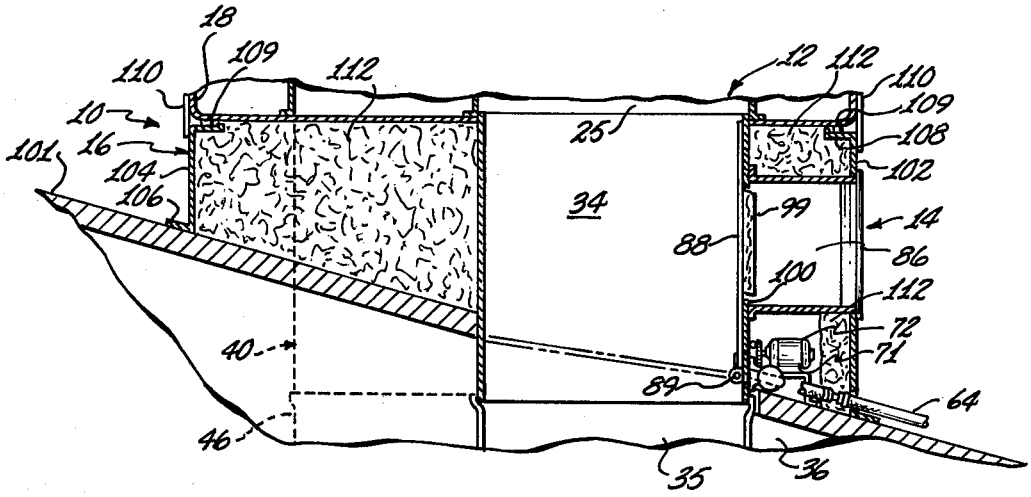
FIG. 3 is a sectional view taken along the line 3—3 of FIG. 2.

Referring now to FIGS. 4, 5 and 6, the air handler ducts 38 and 40 are seen to also include a damper means 70, which is employed to control the flow of air returning from the building 36 to the air conditioning structure 12. The damper means 70 replaces the lower damper assemblies (not shown), which as previously described, were located in the auxiliary air inlets 28 of the air conditioning structure disclosed in the hereinbefore referenced U.S. patent. The purpose for relocating the dampers is to remove them as far as possible from the corrosive environment of the air conditioning structure, simplify the construction thereof and improve access for servicing purposes. The damper means 70 includes a suitable servo motor 72, mounted on a bracket 71 (FIG. 3), with a disc 73 mounted for rotation with the shaft of the motor. A control rod 75 is pivotably connected intermediate its opposite ends to a pin 76 which extends eccentrically from the disc 73. The opposite ends of the control rod 75 are connected by means of pivot pins 77 to levers 78 and 79. The lever 78 is connected to the extending end of an elongated shaft 80 which is rotatably mounted within the chamber 54 of the return air handler duct 38 on suitable bushings. The lever 79 is similarly connected to the extending end of an elongated shaft 81 which is rotatably mounted within the chamber 54 of the return air handler duct 40 on suitable bushings. Each of the elongated shafts 80 and 81 has a damper plate 84 affixed thereon, and as best seen in FIG. 4, those damper plates 84 are movable from open positions shown in solid lines to closed positions shown in dashed lines.

Thus, air movement through the return air handler ducts 38 and 40 is controllable by actuation of the servo motor 72. Such actuation causes rotation of the disc 73 which results in substantially linear movement of the control rod 75, and control rod movements in turn cause rotation of the shafts 80 and 81 to move the damper plates 84 as described above.

The air handler mechanism 14 also includes an exhaust duct 86 which extends laterally from the supply spanner duct 34 and is in communication therewith. A damper plate 88 is mounted within the supply spanner duct 34 on a rod 89 carried in suitable bushings 90 so that the damper plate 88 is pivotably movable between the solid line position (FIG. 3) in which the exhaust duct 86 is closed, and the phantom line position in which the supply spanner duct 34 is closed. A suitable servo motor 92 is mounted on the air handler mechanism 14 and has a disc 93 fixed to rotate with the shaft of the motor. A lever 95 is pivotably coupled to a pin 96 carried on the disc 93 and positioned to extend eccentrically therefrom. The lever 95 extends from the pin 96 through an opening formed in the supply spanner duct 34 and has its opposite end pivotably affixed by a pin 97 carried in a clevis 98 extending from the damper plate 88. Thus, air from the centrifugal blower 24 of the air conditioning structure 12 may be optionally directed into the building 36 or may be exhausted into the atmosphere by appropriate positioning of the damper plate 88 by means of the servo motor 92.

The damper plate 88 is preferably provided with insulative material 99 affixed to the surface thereof which faces the exhaust duct 86 to retard heat transfer between the supply spanner duct 34 and the exhaust duct when the damper plate 88 is in the position which closes the exhaust duct. It will be noted that the insulative material 99 is configured to have sloping top and bottom surfaces so that any condensation which may collect in this area will be directed into the exhaust duct 86 rather than being allowed to enter and/or return to the supply spanner duct 34. Toward that same end, the junction of the supply spanner duct 34 with the exhaust duct 86 is provided with an endless lip 100 which prevents moisture from entering into the supply spanner duct.

The damper plate 88 will be in the position of closing the exhaust duct 86 during periods when the air of the point of use (building 36) is being heated, cooled or merely recirculated. The plate 88 is moved to the position which closes the supply spanner duct 34 when ventilation of the point of use is desired. In the ventilation mode, only the centrifugal blower 24 of the air conditioning structure 12 is operated to draw air from the point of use through the return air handler ducts 38 and 40, and will exhaust that air into the atmosphere.

As is customary, devices of the nature of the instant type are mounted on the roofs of buildings and must be suitably supported thereon. In prior art installations, the air conditioning structure is usually supported on an angle iron frame (not shown). The air conditioning assembly 10 of the present invention is, however, supported on the previously mentioned especially designed stand-enclosure 16 as will now be described in detail.

The stand-enclosure 16 is a sheet metal structure which extends between the roof 101 of the building 36 and the bottom of the air conditioning structure 12, and is in the form of an endless upstanding wall configured to provide a front wall 102, an opposed pair of side walls 103 and a rear wall 104. The walls 102, 103 and 104 have an extending flange 106 formed on the lower ends thereof by which the stand-enclosure 16 is suitably affixed to the roof 101. The upper ends of the walls 102, 103 and 104 are configured to form an endless inwardly directed lip 108 which serves as a support means, and upon which a suitable endless seal 109 is affixed, with the seal being in engagement with the bottom surface of the housing 17. Thus, the air conditioning structure 12 is supported atop the stand-enclosure 16 and the seal prevents moisture from entering into the area which has its periphery defined by the enclosure 16.

The air conditioning structure 12 may be fixedly mounted to the enclosure-stand 16 in any of several manners such as by a plurality of straps 110 attached to the stand 16 so as to extend upwardly therefrom at appropriately spaced locations, with the straps having hook portions 111 (FIG. 4) formed on the upper ends thereof which are in engagement with the upper edge of the sump 18 of the housing 17.

In addition to the above described function of supporting the air conditioning structure 12, the stand-enclosure 16 is employed to retain suitable insulative material 112 between the inwardly facing surfaces thereof and the various peripheral surfaces of the air handler mechanism 14. The walls 102, 103 and 104, and the endless seal 109 enclose the insulative material 112 so that the elements in general are kept away from the material, and in particular moisture in the form of rain or liquid from the air conditioning structure 12 will not come in contact with the insulative material 112.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles.

For example, the stand-enclosure 16 is shown as being configured to mount on a pitched roof 101, and obviously it could be configured to mount on a flat roof (not shown). Further, the manner of mounting the air conditioning structure 12 on the stand-enclosure 16 and sealing of the junction therebetween could be accomplished in various ways, such as by forming an angular in cross section inwardly facing rail (not shown) on the upper end of the enclosure 16, with the air conditioning structure 12 being seated in the rail which is provided with suitable drain holes (not shown).

The appended claims are therefore intended to cover and embrace any such modifications within the limits only of the true spirit and scope of the invention.

What I claim is:

1. An air conditioning assembly comprising:

(a) an air conditioning structure having an air outlet opening formed centrally in one surface thereof and at least one auxiliary air inlet opening formed in that same surface adjacent the air outlet opening;

(b) a supply spanner duct connected to the air outlet opening of said air conditioning structure for directing air from said air conditioning structure to a point of use;

(c) a return air handler duct connected to the auxiliary air inlet of said air conditioning structure for directing air returning from a point of use to said air conditioning structure;

(d) an air treatment device mounted within said return air handler duct for treating the air passing therethrough;

(e) an exhaust duct communicating with said supply spanner duct and extending laterally therefrom; and (f) damper means mounted proximate the junction of said exhaust duct with said supply spanner duct and pivotably movable between a position where said exhaust duct is closed and a position where said supply spanner duct is closed.

2. An air conditioning assembly as claimed in claim 1 and further comprising:

(a) a liquid removal system mounted in said return air handler duct and extending exteriorly thereof for removing liquids from the interior of said return air handler duct; and (b) damper means pivotably mounted in said return air handler duct for movement between a position of opening said return air handler duct and a position for closing thereof.

3. An air conditioning assembly as claimed in claim 1 wherein said return air handler duct comprises:

(a) a first side wall of substantially planar configuration;

(b) a second side wall spaced from and opposite with respect to said first side wall, said second side wall having an intermediate portion which extends angularly and away from said first side wall;

(c) an opposed pair of end walls; and (d) said first and second side walls and said opposed pair of end walls integrally formed to define an outlet opening, a relatively larger inlet opening with an enlarged chamber therebetween adjacent said relatively larger inlet opening.

4. An air conditioning structure as claimed in claim 3 wherein said air treatment device is located within the enlarged chamber of said return air handler duct and is disposed to extend angularly between said first and second side walls.

5. An air conditioning structure as claimed in claim 1 and further comprising:

(a) thermally insulative material disposed to engage the peripheral surfaces of said supply spanner duct and said return air handler duct; and (b) stand-enclosure means for demountably supporting said air conditioning structure and for protectively enclosing said thermally insulative material.

6. An air conditioning assembly comprising:

(a) an air conditioning structure having an air outlet opening formed centrally in the bottom surface thereof and at least one auxiliary air inlet opening formed adjacent the air outlet opening;

(b) a supply spanner duct coupled to the air outlet opening of said air conditioning structure for directing air therefrom to a point of use;

(c) a return air handler duct coupled to the auxiliary air inlet opening of said air conditioning structure for directing air from the point of use to said air conditioning structure, said return air handler duct having an enlarged chamber formed therein;

(d) an air treatment device mounted within the enlarged chamber of said return air handler duct;

(e) thermally insulative material in engagement with the peripheral surfaces of said supply spanner duct and said return air handler duct; and (f) stand-enclosure means for demountably supporting said air conditioning structure and for protectively enclosing said thermally insulative material.

7. An air conditioning assembly as claimed in claim 6 wherein said stand-enclosure means comprises:

(a) an endless upstanding side wall;

(b) means on the lower edge of said endless side wall for attachment to the roof of a building;

(c) support means on the upper edge of said endless side wall for supporting said air conditioning structure; and (d) seal means interposed between said support means and the bottom surface of said air conditioning structure for sealing the area enclosed by said upstanding side wall.

8. An air conditioning assembly as claimed in claim 7 wherein said stand-enclosure means further comprises means on said endless upstanding side wall and extending upwardly therefrom into engagement with said air conditioning structure for demountably attaching said air conditioning structure to said stand-enclosure means.

9. An air conditioning assembly as claimed in claim 6 and further comprising damper means within the enlarged chamber of said return air handler duct for selective opening and closing thereof.

10. An air conditioning assembly as claimed in claim 6 and further comprising a liquid removal system within the enlarged chamber of said return air handler duct and extending therefrom exteriorly of said stand-enclosure means, said liquid removal system for removing liquid from said return air handler duct and directing that liquid exteriorly of said stand-enclosure means.

11. An air conditioning assembly as claimed in claim 6 and further comprising:

(a) an exhaust duct communicating with said supply spanner duct and extend laterally therefrom; and (b) damper means pivotably mounted proximate the junction of said exhaust duct and said supply spanner duct and pivotably movable between a first position in which said exhaust duct is closed and said supply spanner duct is open and a second position in which said exhaust duct is open and said supply spanner duct is closed.

12. An air conditioning assembly as claimed in claim 11 wherein said damper means comprises a flat damper plate having thermally insulative material affixed to the surface thereof which faces said exhaust duct when said damper means is in said first position.

* * * * *